US009567656B2

(12) United States Patent
Imano et al.

(10) Patent No.: US 9,567,656 B2
(45) Date of Patent: Feb. 14, 2017

(54) NICKEL BASED ALLOY FOR FORGING

(71) Applicant: MITSUBISHI HITACHI POWER SYSTEMS, LTD., Kanagawa (JP)

(72) Inventors: Shinya Imano, Hitachi (JP); Hiroyuki Doi, Tokai (JP); Jun Sato, Hitachi (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 116 days.

(21) Appl. No.: 14/496,110

(22) Filed: Sep. 25, 2014

(65) Prior Publication Data

US 2015/0017015 A1 Jan. 15, 2015

Related U.S. Application Data

(63) Continuation of application No. 12/253,262, filed on Oct. 17, 2008, now Pat. No. 8,956,471.

(30) Foreign Application Priority Data

Oct. 19, 2007 (JP) ..... 2007-271925

(51) Int. Cl.

| | |
|---|---|
| ***C22F 1/10*** | (2006.01) |
| ***C22C 19/05*** | (2006.01) |
| ***F01D 5/06*** | (2006.01) |

(52) U.S. Cl.

CPC ..... *C22C 19/055* (2013.01); *C22C 19/056* (2013.01); *C22F 1/10* (2013.01); *F01D 5/063* (2013.01); *F05C 2201/0466* (2013.01); *F05C 2251/04* (2013.01); *F05C 2253/24* (2013.01)

(58) Field of Classification Search

CPC ..... C22C 19/056; C22C 19/055; C22F 1/10; F01D 5/063; F05C 2201/0466; F05C 2251/04; F05C 2253/24

See application file for complete search history.

(56) References Cited

U.S. PATENT DOCUMENTS

| | | | |
|---|---|---|---|
| 3,660,177 | A | 5/1972 | Brown et al. |
| 4,161,412 | A | 7/1979 | Henry |
| 4,571,935 | A | 2/1986 | Rice |
| 5,788,785 | A | 8/1998 | DeLuca |
| 6,562,157 | B2 | 5/2003 | Nonomura et al. |

FOREIGN PATENT DOCUMENTS

| | | | |
|---|---|---|---|
| EP | 0 297 785 | A2 | 1/1989 |
| EP | 0 560 296 | A1 | 9/1993 |
| EP | 0 753 704 | A1 | 1/1997 |
| EP | 1 065 290 | A1 | 1/2001 |
| EP | 1 410 872 | A1 | 4/2004 |

(Continued)

OTHER PUBLICATIONS

JP Office Action of JP Appln. No. 2012-095206 dated May 28, 2013 with English translation.

(Continued)

*Primary Examiner* — Jessee Roe
(74) *Attorney, Agent, or Firm* — Crowell & Moring LLP

(57) ABSTRACT

A nickel (Ni) based alloy for forging includes: 0.001 to 0.1 wt. % of carbon (C); 12 to 23 wt. % of chromium (Cr); 3.5 to 5.0 wt. % of aluminum (Al); 5 to 12 combined wt. % of tungsten (W) and molybdenum (Mo) in which the Mo content is 5 wt. % or less; a negligible small amount of titanium (Ti), tantalate (Ta) and niobium (Nb); and the balance of Ni and inevitable impurities.

2 Claims, 4 Drawing Sheets

(56) References Cited

FOREIGN PATENT DOCUMENTS

| | | |
|---|---|---|
| EP | 1 717 326 A2 | 11/2006 |
| JP | 10-331659 | 12/1998 |
| JP | 2004-036469 | 2/2004 |
| JP | 2004-256840 | 9/2004 |
| JP | 2005-097650 | 4/2005 |

OTHER PUBLICATIONS

European Search Report of EP application 08018325.4 dated Feb. 12, 2009.

Smith, G.D. Future Trends in Key Nickel Alloy Markets, Nickel: A Century of Innovation, JOM, Sep. 2006, p. 38 and 39.

ASM International, Materials Park, Ohio, ASM Specialty Handbook: Nickel, Cobalt, and Their Alloys, Metallography, Microstructures, and Phase Diagrams and Nickel and Nickel Alloys, Dec. 2000, pp. 302-304.

Choudhury, I.A., Machinability of Nickel-Base Super Alloys: A General Review, Journal of Materials Processing Technology, 77, 1998, pp. 278-284.

ASM International, Materials Park, Ohio, ASM Specialty Handbook: Nickel, Cobalt, and Their Alloys, "Wrought Corrosion Resistant Nickel and Nickel Alloys", Dec. 2000, pp. 14-19.

BOILER TUBE

TURBINE ROTOR

BOLT AND NUT EXPOSED TO HIGH TEMP.

NICKEL BASED ALLOY FOR FORGING

CROSS-REFERENCE TO RELATED APPLICATION

This application is a continuation application of U.S. application Ser. No. 12/253,262, now U.S. Pat. No. 8,956,471, filed Oct. 17, 2008, the contents of which are incorporated herein by reference.

CLAIM OF PRIORITY

The present application claims priority from Japanese patent application serial no. 2007-271925 filed on Oct. 19, 2007, the content of which is hereby incorporated by reference into this application.

BACKGROUND OF THE INVENTION

1. Field of the Invention

The present invention relates to Ni based alloys, and it particularly relates to Ni based alloys for forging having excellent high temperature strength and oxidation resistance.

2. Description of Related Art

In order to improve the power generation efficiency of generators such as steam and gas turbine generators, it is effective to raise the main steam temperature or combustion temperature. When the main steam (or combustion) temperature of a generator is increased, the temperatures of the generator components also rise. Such components used at higher temperatures than conventional ones require to be made of materials having a higher maximum allowable use temperature.

Materials for high temperature components are classified into those for precision casting and these for forging, depending on the use temperature and the component size. Small components used at high temperatures (such as stator vanes and rotor blades of a gas turbine) are usually formed by precision casting. On the other hand, large components are usually formed by forging because they are difficult to precision cast. Forging materials are generally hot forged in the temperature range of 1000 to 1200° C., and therefore desirably have low deformation resistance above 1000° C. to ensure workability.

Nickel (Ni) based superalloys strengthened by γ' phase ($Ni_3Al$) precipitation have excellent high temperature strength, and are therefore widely used for forging high temperature components. However, the presence of γ' phase precipitates in the superalloy reduces hot workability. The γ' phase is stable at lower temperatures and dissolves into a matrix above a threshold temperature. Therefore, hot working is usually performed above the temperature of solid solution limit line (solvus temperature) of the γ' phase (a threshold temperature at which γ' phase precipitates disappear).

The larger the amount of γ' phase precipitation in an alloy is, the higher the strength of the alloy is; so it is desirable to increase the amount of γ' phase precipitation at the use temperatures of the alloy. However, increase in the amount of γ' phase precipitation will result in an increase in the temperature of solid solution limit line (solvus temperature) of the γ' phase, thus reducing the hot workability. This has hitherto prevented any significant improvement in the high temperature strength of forging materials strengthened by γ' phase precipitation.

Generally, high temperature components are required to have a 100,000-hour creep rupture strength of 100 MPa at their use temperatures. In conventional materials, it has been necessary that the temperature of solid solution limit line of the γ' phase of a forging alloy is suppressed to 1000° C. or lower in order to ensure sufficient hot workability, the allowable use temperatures of the alloy, at which the above-mentioned strength requirement is satisfied, is limited to 750° C. or lower.

In addition, such alloys are significantly oxidized above 750° C. Therefore, it is also essential to increase the oxidation resistance of an alloy in order to increase the maximum allowable use temperature to higher than 750° C. In order to increase the oxidation resistance of an alloy, it is effective to add aluminum (Al) to the alloy since oxides of Al are stable. However, addition of Al to an alloy increases the temperature of solid solution limit line of the γ' phase and reduces the hot workability. Because of this, in conventional forging alloys, the Al content is limited to 3 wt. % or less, which is insufficient for stably forming oxides of Al.

Furthermore, according to conventional knowledge, it is also essential to add niobium (Nb), titanium (Ti) and tantalate (Ta) to conventional Ni based forging alloys in order to stabilize the γ' phase at higher temperatures and increase the strength (see JP-A-2005-97650). However, for forging alloys strengthened by γ' phase precipitation, prior arts cannot simultaneously achieve sufficient hot workability and sufficient high temperature strength.

SUMMARY OF THE INVENTION

Under these circumstances, in order to address the above problems, it is an objective of the present invention to provide an Ni based alloy for forging in which the maximum allowable use temperature is increased to a range from 760 to 800° C. while good hot workability is maintained. That is, the above objective of the invention is to increase the maximum allowable use temperature of Ni based alloys for forging from 750° C. (which is the limit of conventional alloys) to a range of 760-800° C. while maintaining hot workability comparable to those of the conventional alloys.

Furthermore, it is another objective of the present invention to form an Al coating film on a surface of the Ni based alloys for forging in order to provide improved oxidation resistance at the use temperatures of the alloy.

In order to accomplish the above objectives, the present inventors have precisely studied the compositions of Ni based alloys for forging which can stabilize the γ' phase at lower temperatures and destabilize that at higher temperatures. And finally, the inventors have found the optimal compositions of Ni based alloys for forging which can greatly increase the maximum allowable use temperature without sacrificing the hot workability.

(1) According to one aspect of the present invention, there is provided a nickel (Ni) based alloy for forging including: 0.001 to 0.1 wt. % of carbon (C); 12 to 23 wt. % of chromium (Cr); 3.5 to 5.0 wt. % of aluminum (Al); 5 to 12 combined wt. % of tungsten (W) and molybdenum (Mo) (wherein the Mo content is 5 wt. % or less); a negligible small amount of titanium (Ti), tantalate (Ta) and niobium (Nb); and the balance of Ni and inevitable impurities.

(2) According to another aspect of the present invention, there is provided an Ni based alloy for forging including: 0.001 to 0.1 wt. % of C; 12 to 23 wt. % of Cr; 3.5 to 5.0 wt. % of Al; 15 to 23 wt. % of cobalt (Co); 5 to 12 combined wt. % of W and Mo (wherein the Mo content is 5 wt % or less); 1 or less combined wt. % of rhenium (Re), ruthenium (Ru) and indium (In); 0.5 or less combined wt. % of Ti, Ta and Nb; and the balance of Ni and inevitable impurities.

In the above aspects (1) and (2) of the present invention, the following modifications and changes can be made.

(i) $Ni_3Al$ phase grains of an average diameter of 50 to 100 nm precipitate in the Ni based alloy for forging with a volume percentage of 30% or more at or below 700° C.; the temperature of solid solution limit line (solvus temperature) of the $Ni_3Al$ phase is 1000° C. or lower; the 100,000-hour creep rupture strength of the alloy is 100 MPa or more at 750° C.; and the C content is within a range from 0.001 to 0.04 wt. %.

(ii) A component for use in a steam turbine plant is made of the Ni based alloy for forging.

(iii) A boiler tube for use in a steam turbine plant having a main steam temperature of 720° C. or higher; a bolt for use in a steam turbine plant and used at a temperature of 750° C. or higher; and a steam turbine rotor used at a temperature of 750° C. or higher are made of the Ni base alloy for forging.

Advantages of the Invention

The invention can provide an Ni based alloy for forging in which the maximum allowable use temperature is increased to a range from 760 to 800° C. while the hot workability is not sacrificed.

DETAILED DESCRIPTION OF THE PREFERRED EMBODIMENTS

Figure 1:
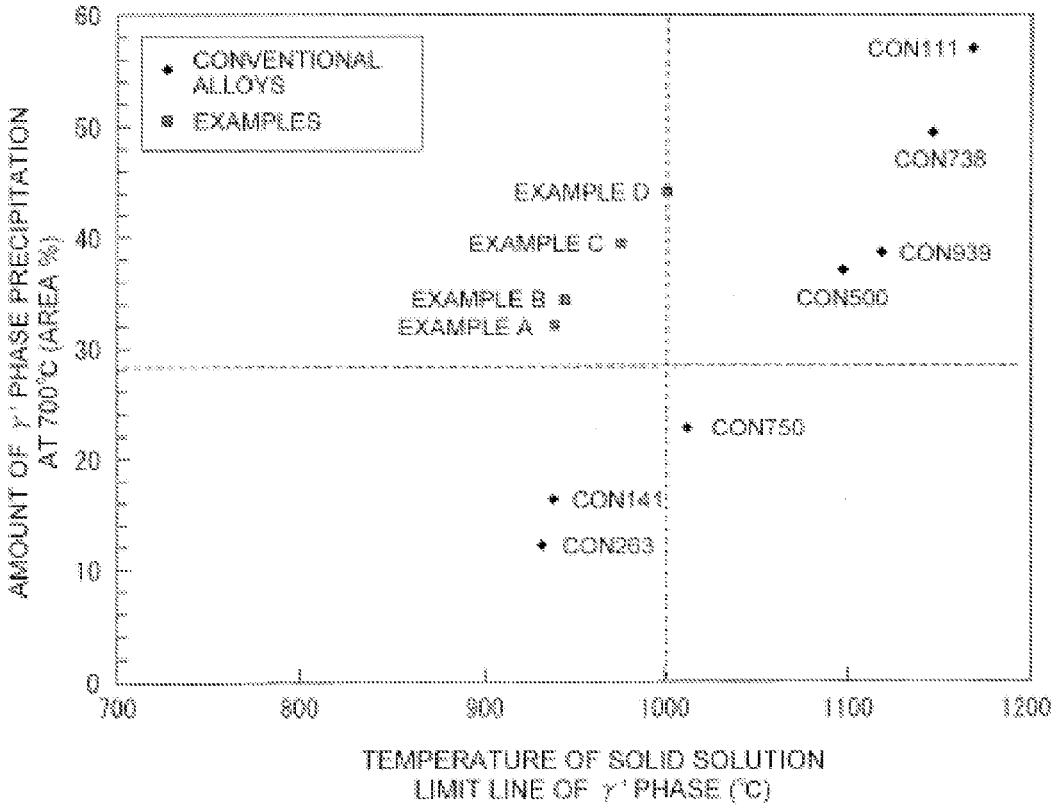
FIG. 1 shows a relationship between temperature of solid solution limit line of the γ' phase and amount of the γ' phase precipitation at 700° C. in Examples A to D and conventional alloys.

First, the compositional balances (optimal chemical compositions) of Ni based alloys for forging in the present invention will be described together with the rationale for such optimality.

The Cr is an important element for improving the corrosion resistance of an alloy, and addition of 15 wt. % or more of Cr to the alloy is typically needed for such purpose. However, excessive addition of Cr causes precipitation of the σ phase (known as an embrittling phase), so the addition of Cr is preferably suppressed to 23 wt. % or less.

In a high temperature range of hot working for an Ni based alloy (e.g., 1000 to 1200° C.), the Ti, Ta and Nb stabilize the γ' phase and contribute to the strengthening of the alloy, but has only limited contribution such stabilization near the use temperature (750° C.). Therefore, such elements are desirably not added to a superalloy when greater importance is placed on hot workability than strength. In this respect, the present invention is different from design concepts of a conventional alloy. Furthermore, the Ti, Ta and Nb are apt to be oxidized. Accordingly, in one aspect of the present invention, the Ni based alloy for forging preferably includes a negligible small amount of Ti, Ta and Nb. As used in the present invention, the expression of "an alloy includes a negligible small amount of a material" means that the material is not intentionally added to the alloy, but it can incidentally contaminate the alloy (e.g., less than 0.04 combined wt. % of Ti, Ta and Nb measured with inductively coupled plasma-atomic emission spectrometry (ICP-AES)). In another aspect of the present invention, the Ni based alloy for forging may include 0.5 or less combined wt. % of Ti, Ta and Nb.

The Al stabilizes the γ' phase of an alloy and improves the strength and oxidation resistance. The Al content in the alloy is preferably 3.5 wt. % from a standpoint of the oxidation resistance, while it is preferably 4 wt. % or more from a standpoint of the strength. However, an Al content more than 5 wt. % will increase the temperature of solid solution limit line of the γ' phase, thereby reducing the hot workability.

Addition of the Co to an alloy has an effect of reducing the temperature of solid solution limit line of the γ' phase, thus enabling reduction in the lower limit temperature for good hot workability and facilitating the hot working. Such addition of the Co also has an effect of improving oxidation resistance, and the Co content in the alloy is preferably 15 wt. % or more for such purpose. However, the Co content needs to be suppressed to 23 wt. % or less because excessive addition of the Co stabilizes the σ phase.

Also, it is desirable to increase the strength of a matrix itself by solid solution in which the γ' phase precipitates. Further, it is also desirable to reduce the diffusion coefficient of Al in order to suppress coarsening of the γ' phase precipitates. For these purposes, addition of a high melting temperature metal such as the Mo, W, Re, Ru and In is desired, and the W is particularly preferable. To ensure the above-mentioned effects, the W is preferably contained in the alloy in an amount of 5 wt. % or more.

However, excessive addition of the W stabilizes the σ and μ phases of an Ni based alloy. Also, the strengthening effect by solid solution for the matrix is still present above the temperature of solid solution limit line of the γ' phase, thus causing adverse effects on the hot workability. Therefore, the W content needs to be suppressed to 12 wt. % or less.

Addition of the Mo to the alloy has effects of improving the strength and stabilizing the phases, which are similar to those of the addition of W. However, excessive addition of the Mo can cause segregation defects. As a result of these considerations, the Mo content needs to be suppressed to 5 wt. % or less, and the combined content of the Mo and W needs to be suppressed to 12 wt. % or less. Furthermore, the combined content of the Re, Ru and In needs to be suppressed to 1 wt. % or less.

An Ni based alloy according to the present invention based on the above-described concept exhibits excellent creep strength and oxidation resistance while maintaining good hot workability comparable to those of conventional alloys such as NIMONIC 263 (NIMONIC is a registered trademark). The Ni based alloy according to the present invention is characterized in that it has a 100,000-hour creep rupture strength of 100 MPa or more at a temperature of 750° C. and has an oxidation protecting film of Al oxide self-formed thereon by a high-temperature oxidation treatment. Conventional alloys having advantages of such high creep rupture strength and such self formation of an oxidation protecting film are difficult to be hot forged and need to be precision cast. However, the present invention enables hot forging of alloys having such excellent properties.

EXAMPLES

Table 1 shows nominal compositions of test samples (Examples A to D in the present invention and comparative examples). Herein, the comparative examples having a name beginning with "CON" are a conventional Ni based alloy.

TABLE 1

Nominal Composition of Test Samples (wt. %)

| Sample | C | Ni | Cr | Mo | Co | Al | Ti | W | Nb | Ta |
|---|---|---|---|---|---|---|---|---|---|---|
| CON939 | 0.14 | Bal. | 23.2 | | 18.7 | 1.9 | 3.8 | 2.1 | 1.0 | 1.38 |
| CON500 | 0.08 | Bal. | 8.3 | 0.49 | 9.2 | 5.4 | 0.8 | 9.4 | | 3.19 |
| CON750 | 0.05 | Bal. | 19.5 | 4.3 | 13.5 | 1.3 | 3 | | | |
| CON222 | 0.11 | Bal. | 22 | 0 | 20 | 1.18 | 2.28 | 2 | 0.8 | 1.01 |
| CON738 | 0.12 | Bal. | 22.9 | | 20.6 | 1.6 | 2.8 | 7.1 | 0.9 | 1.18 |
| CON111 | 0.12 | Bal. | 15.0 | 3 | 15 | 1.6 | 3 | 7.1 | 0.9 | 1.18 |
| CON141 | 0.03 | Bal. | 19.0 | 10.2 | | 1.58 | 1.38 | | | |
| Example A | 0.03 | Bal. | 15 | 3.5 | 18 | 3.7 | 0 | 5.1 | 0 | 0 |
| Example B | 0.03 | Bal. | 15 | 0 | 20 | 4 | 0 | 7 | 0 | 0 |
| Example C | 0.03 | Bal. | 16 | 0 | 21 | 4.2 | 0 | 9 | 0 | 0 |
| Example D | 0.03 | Bal. | 17 | 0.1 | 17 | 4.9 | 0 | 7 | 0 | 0 |

Each test alloy was molten by a high frequency melting furnace and was solidified. And, in order to prepare the test samples, forgeable test alloys were forged and unforgeable ones were precision cast.

FIG. 1 shows a relationship between temperature of solid solution limit line of the γ' phase and amount of the γ' phase precipitation (in area percentage) at 700° C. in Examples A to D and conventional alloys. The temperature of solid solution limit line of the γ' phase can be determined by differential thermal analysis.

The differential thermal analysis was carried out as follows. Firstly, each sample was subjected to a solution and artificially aging treatment to precipitate the γ' phase. The temperature of solid solution limit line was determined from the temperature at which the reaction heat of solution, which was released when the γ' phase precipitates were dissolved (to be solid solution) into the alloy matrix, was detected.

The amount of γ' phase precipitation of each sample at 700° C. was determined by aging the sample at 700° C. for a long period of time and then performing SEM (scanning electron microscopy) image analysis. The aging time was 48 hours.

As shown in FIG. 1, in the conventional alloys, the higher the temperature of solid solution limit line of the γ' phase is, the larger the amount of γ' phase precipitation at 700° C. is and therefore the greater the strength of the alloy is. Since such presence of the γ' phase in an alloy seriously disserves the hot workability, the alloy needs to be hot worked at temperatures higher than the temperature of solid solution limit line of the γ' phase. However, alloys having a temperature of solid solution limit line of the γ' phase of higher than 1050° C. is practically difficult to hot work. Therefore, conventional alloys having a higher strength are more difficult to hot work and can be used for only precision casting.

It is difficult to cast large-size products because of casting defects; so such large-size products need to be forged. However, in conventional forging alloys, the area percentage of the γ' phase which can be precipitated at 700° C. is limited to less than about 25%.

As can be seen from FIG. 1, in the invention's alloys (Examples A to D), the γ' phase can be precipitated in an area percentage of 32% or more at 700° C. even when the temperature of solid solution limit line of the γ' phase is as low as about 1000° C. or less. Thus, the Ni based alloy for forging in the present invention has potential for greatly increasing the high temperature strength than conventional ones.

Figure 2:
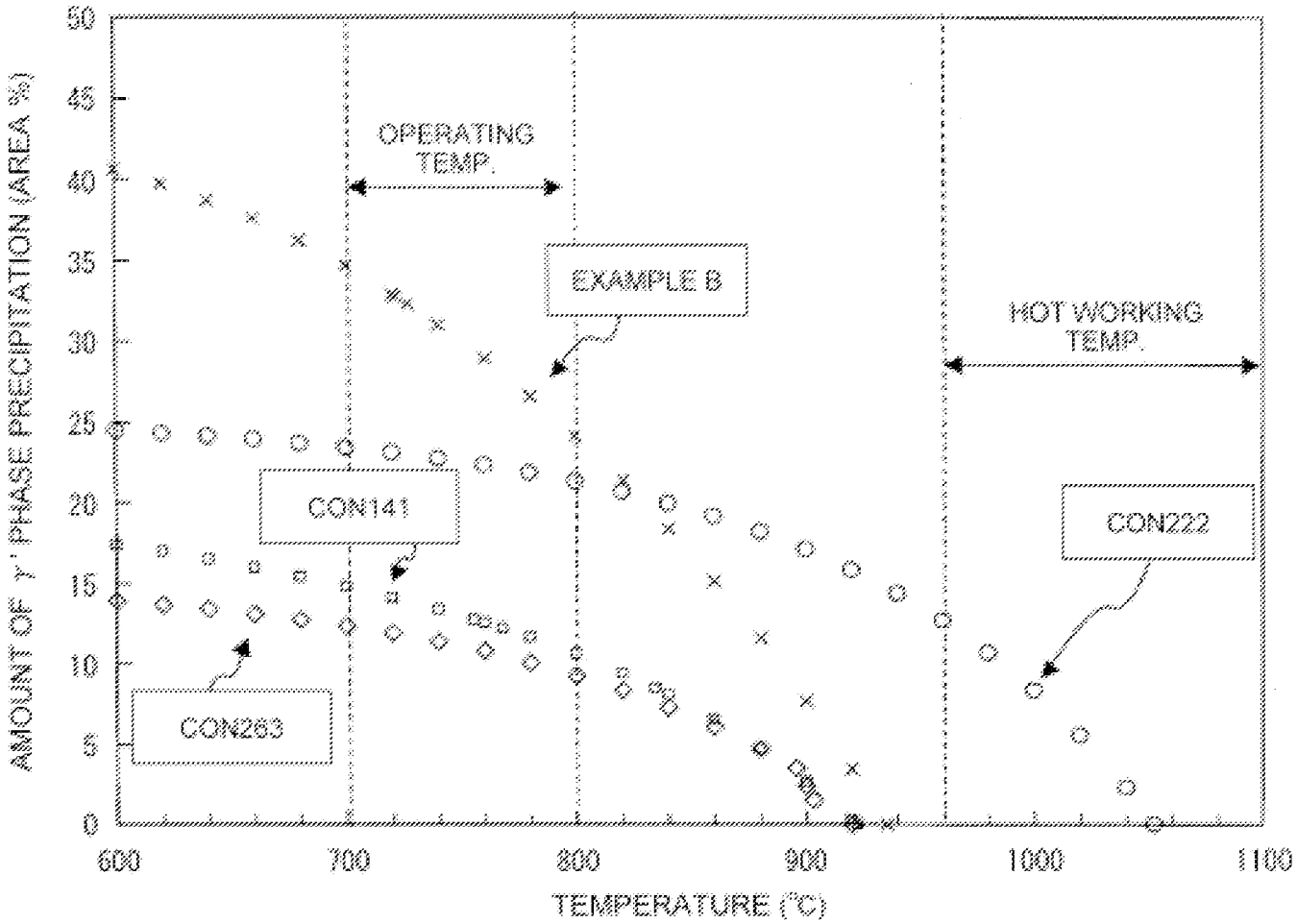
FIG. 2 shows amount of the γ' phase precipitation as a function of temperature in Example B and conventional alloys.

FIG. 2 shows amount of the γ' phase precipitation as a function of temperature in Example B and conventional alloys. In Example B, the amount of the γ' phase precipitation at typical use temperatures of 700-800° C. can be made larger than those obtained in the conventional alloys (e.g., CON141 and CON263), while the temperature of solid solution limit line of the γ' phase is suppressed to lower than typical hot forging temperatures of 1000° C. Besides, CON263 is the same alloy of NIMONIC 263.

The sample CON222 has a temperature of solid solution limit line of the γ' phase of about 1050° C., and is difficult to hot work. Thus, alloys having a composition similar to that of the sample CON222 can be used only for precision casting products such as gas turbine stator vanes. In addition, the 100,000-hour creep rupture strength of the sample CON222 at 800° C. is in the range of 100 MPa. By contrast, in Example B, the amount of the γ' phase precipitation at 700-800° C. can be made comparable to or larger than those obtained in conventional precision casting alloys (e.g., CON222) for gas turbine stator vanes while the temperature of solid solution limit line of the γ' phase can be suppressed to a temperature level comparable to those obtained in conventional forging alloys (e.g., CON141 and CON263).

Next, results of measuring the high temperature strength will be described. The measurement was performed for Examples A, B and C as the invention's alloys. As comparative alloys, the samples CON141, CON263 and CON222 were used.

Each sample alloy (20 kg) was molten and solidified by a high frequency vacuum melting furnace, and was then hot forged to prepare a 40-mm-diameter rod. The forging temperature was 1050-1200° C. All the samples other than the sample CON222 could be forged without any problem.

However, the sample CON222 suffered from surface cracks. This is because CON222 alloy is difficult to be forged and its application is usually limited to precision casting of products such as gas turbine stator vanes, as described before. Then, the forging operation for the sample CON222 was continued while the cracks were being removed with a grinder.

After that, the 40-mm-diameter round rod was worked and thinned to 15 mm-diameter with a hot swaging apparatus. The sample CON222 developed large cracks when it was thinned to about 30 mm diameter and could not continue to be forged.

The other samples could be hot worked to a 15-mm-diameter round rod without any problem. The samples were subjected to a solution treatment above the temperature of solid solution limit line of the γ' phase, and were then subjected to an artificially aging treatment below the temperature of solid solution limit line of the γ' phase to form γ' phase precipitates of 50 to 100 nm in size. A creep test piece having a gauge portion of 6 mm in diameter and 30 mm in length was machined out of the 15-mm-diameter round rod solution treated and artificially aged, and was subjected to a creep test at 800-850° C.

Figure 3:
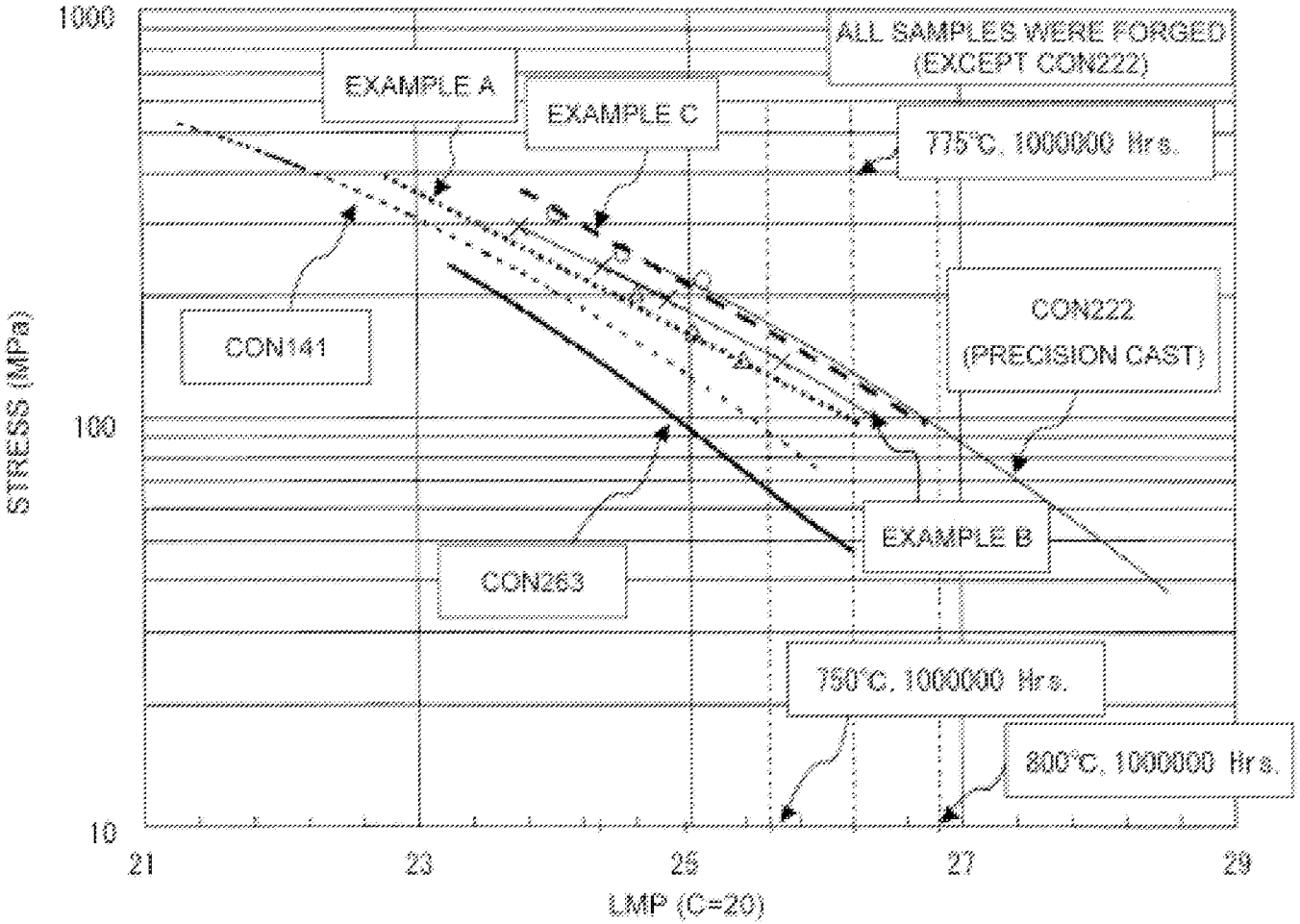
FIG. 3 shows results of creep rupture test in Examples A to C and conventional alloys.

FIG. 3 shows results of the creep rupture test in Examples A to C and conventional alloys. It should be added that since the sample CON222 was difficult to be hot worked, the ingot for the sample CON222, which had been obtained by vacuum melting, was remelted and precision cast to a 15-mm-diameter round rod.

As shown in FIG. 3, Examples A to C of the present invention have a creep rupture strength higher than those of the samples CON141 and CON263. Also, Examples A to C exhibit a creep rupture life more than three times that of the sample CON750 (not shown in FIG. 3). Herein, the creep rupture endurable temperature of a material is defined as an estimated temperature at which the material has a 100,000-hour creep rupture strength of 100 MPa, and can be estimated using the Larson-Miller parameter LMP {LMP=(T× log [t+20])/1000, where T=absolute temperature and t=creep rupture time}. The creep rupture endurable temperatures of Examples A, B and C are respectively 775° C., 780° C. and 800° C., which are higher than the creep rupture endurable temperature (750° C.) of the sample CON750. Furthermore, Example D (not shown in FIG. 3) exhibited a still higher creep strength.

The above results show that the Ni based alloys for forging in the present invention have hot workability comparable to those of conventional alloys while achieving a strength much higher than those of the conventional alloys. The invention can further improve the efficiency of steam and gas turbine generators, thus leading to significant reduction in $CO_2$ emission.

Exemplary components forged from the Ni based alloy of the present invention will be described below.

Figure 4A:
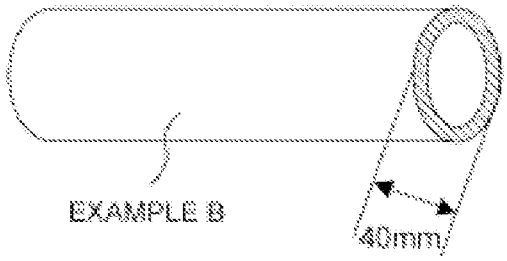
FIG. 4A is a schematic illustration showing a perspective view of an example of a boiler tube for use in a steam turbine plant.

FIG. 4A is a schematic illustration showing a perspective view of an example of a boiler tube for use in a steam turbine plant. The maximum temperature of the main steam of currently used steam turbine plants is limited to 600-620° C. Then, in order to increase the main steam temperature up to 700° C. for higher efficiency, research and development efforts are being carried out. When the main steam temperature is 700° C., the boiler temperature rises above 750° C. Because the maximum allowable use temperature of conventional forging alloys is limited to 750° C., it is difficult to increase the main steam temperature to 700° C. or higher.

On the other hand, 750-800° C. or higher is the maximum allowable use temperature of the Ni based alloys in the present invention. So, a boiler tube made of the alloy of the present invention can increase the main steam temperature to 730° C. or higher. The main steam enters a turbine where the steam produce work, and exits the turbine and is cooled to about 300° C., and is returned to the boiler which reheats the steam. By using the alloy of the invention, the temperature of the reheated steam in the boiler can be raised to 800° C. or higher, and the temperature of the steam entering the turbine can be increased to 750° C. or higher.

Figure 4B:
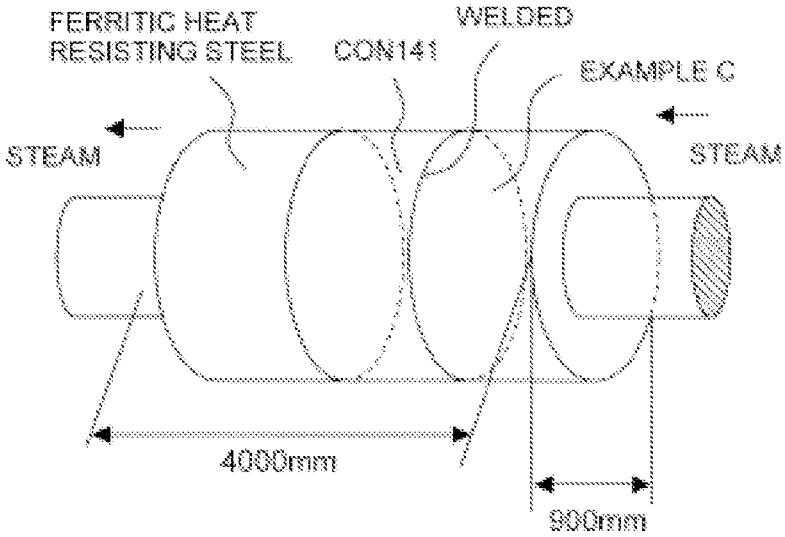
FIG. 4B is a schematic illustration showing a perspective view of an example of a steam turbine rotor for use in a steam turbine plant.

FIG. 4B is a schematic illustration showing a perspective view of an example of a steam turbine rotor for use in a steam turbine plant. Superalloys can not be used for forging products weighing over 10 tons because of the limitations of forging equipment. So, rotors weighing over 10 tons need to be assembled by welding. Typically, a superalloy is used in the high temperature side of a rotor where steam enters, and a ferritic heat resisting steel is used in the low temperature side. The Ni based alloy of the present invention can be used in hottest portions of the rotor. As mentioned before, the maximum allowable use temperature of conventional forging alloys is 750° C. So, when the temperature of the steam in a turbine exceeds 750° C., the steam needs to be cooled by using low temperature steam with high pressure in order to prevent the steam from exceeding the maximum allowable use temperature of the rotor material.

Such a cooling system presents problems of adding complexity to the turbine structure and reducing the thermal efficiency. By contrast, the Ni based alloy of the present invention has a maximum allowable use temperature of 750° C. or higher, thus eliminating such a cooling system when used in high temperature portions of a rotor.

Figure 4C:
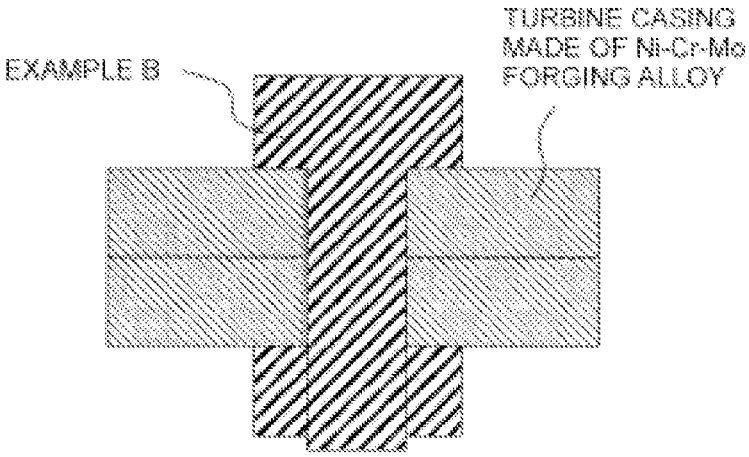
FIG. 4C is a schematic illustration showing a cross-sectional view of an example of a bolt and nut for use in a steam turbine plant.

FIG. 4C is a schematic illustration showing a cross-sectional view of an example of a bolt and nut for use in a steam turbine plant. Turbine casings need to be resistant to high pressure and high temperature, and are typically assembled by bolting together separately cast upper and lower casing parts. Such upper and lower casing parts can withstand high pressure even at higher temperatures by increasing the wall thickness. However, a problem is that when a conventional forging material is used for bolts of a turbine casing, the bolts are prone to loosen due to creep deformation being exposed to a higher temperature than usual. In contrast, the Ni based alloy of the invention exhibits low creep deformation even at higher temperatures, and therefore use of the alloy of the invention as the material of such a bolt and nut can advantageously prevent such loosening of the bolt.

As described above, the Ni based alloy for forging of the present invention can be used in components of high temperature and high pressure systems such as gas and steam turbines. And such the gas and steam turbines can improve the power generation efficiency of generators by increasing the main steam temperature or combustion temperature.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

The invention claimed is:

1. A steam turbine rotor used at a temperature of 750° C. or higher, comprising at least two parts along a steam flow direction and assembled by welding the at least two parts, wherein a higher temperature part of the at least two parts on a side where steam enters is a forged product made of a Ni based alloy, the Ni based alloy including:

0.001 to 0.04 wt. % of C; 12 to 23 wt. % of Cr; 3.5 to 5.0 wt. % of Al; more than 15 wt. % but not more than 23 wt. % of Co; 5 to 12 combined wt. % of W and Mo in which the Mo content is 5 wt. % or less; 0.5 or less combined wt. % of Ti, Ta and Nb; and the balance of Ni and inevitable impurities, wherein $Ni_3Al$ phase grains of an average diameter of 50 to 100 nm precipitate in the alloy with a volume percentage of 30% or more at or below 700° C.; temperature of solid solution limit line (solvus temperature) of the $Ni_3Al$ phase is 1000° C. or lower; and 100,000-hour creep rupture strength of the alloy is 100 MPa or more at 750° C.

2. The steam turbine rotor according to claim 1, wherein the forged product is prepared by a procedure including:

(a) hot forging the Ni based alloy into a predetermined shape at a temperature higher than a temperature of solid solution limit line (solvus temperature) of $Ni_3Al$ phase, (b) subjecting the hot forged alloy to a solution treatment above the temperature of solid solution limit line of the $Ni_3Al$ phase, and (c) subjecting the heat treated alloy to an artificially aging treatment below the temperature of solid solution limit line of the $Ni_3Al$ phase to precipitate $Ni_3Al$ phase grains in the alloy.

* * * * *